US011840903B2

(12) United States Patent
Tulbah et al.

(10) Patent No.: US 11,840,903 B2
(45) Date of Patent: Dec. 12, 2023

(54) DYNAMIC FERROFLUID SHIELD FOR WELL CONTROL

(71) Applicant: SAUDI ARABIAN OIL COMPANY, Dhahran (SA)

(72) Inventors: Faris Hasan Tulbah, Al Khubar (SA); Rafael Adolfo Lastra, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 189 days.

(21) Appl. No.: 17/643,334

(22) Filed: Dec. 8, 2021

(65) Prior Publication Data

US 2023/0175338 A1 Jun. 8, 2023

(51) Int. Cl.

| | |
|---|---|
| ***E21B 33/06*** | (2006.01) |
| ***E21B 35/00*** | (2006.01) |
| *H01F 1/44* | (2006.01) |

(52) U.S. Cl.

CPC ..... *E21B 33/06* (2013.01); *H01F 1/447* (2013.01)

(58) Field of Classification Search

CPC ..... E21B 33/06; E21B 35/00; E21B 43/0122; H01F 1/44; H02N 15/00

See application file for complete search history.

(56) References Cited

U.S. PATENT DOCUMENTS

| | | | | |
|---|---|---|---|---|
| 4,444,398 | A | 4/1984 | Black, Jr. et al. | |
| 6,290,894 | B1 * | 9/2001 | Raj | H01F 1/44 264/405 |
| 8,789,607 | B2 * | 7/2014 | Jelsma | E21B 43/0122 166/93.1 |
| 9,016,373 | B2 | 4/2015 | VanDelden | |
| 9,163,475 | B2 * | 10/2015 | Meinke | E21B 33/12 |
| 9,797,222 | B2 * | 10/2017 | Goodman | E21B 41/00 |
| 10,047,590 | B2 * | 8/2018 | Donderici | E21B 33/124 |
| 10,598,810 | B2 | 3/2020 | Mandviwala et al. | |
| 10,899,638 | B2 * | 1/2021 | Shulgin | C02F 1/463 |
| 11,242,725 | B2 * | 2/2022 | Fripp | E21B 23/06 |
| 11,506,014 | B1 * | 11/2022 | Zhang | E21B 36/008 |
| 2008/0060710 | A1 * | 3/2008 | Carlson | F16K 13/10 137/807 |

FOREIGN PATENT DOCUMENTS

| | | |
|---|---|---|
| CA | 2656619 C | 1/2013 |
| CA | 2845586 C | 8/2016 |
| DK | 2994608 T3 | 7/2018 |
| WO | 2016/060673 A1 | 4/2016 |

OTHER PUBLICATIONS

Lawrence Berkeley National Laboratory; "New laws of attraction: Scientists print magnetic liquid droplets"; Jul. 18, 2019 (5 pages).

Heunis, C. et al.; "Flexible Instruments for Endovascular Interventions"; IEEE Robotics & Automation Magazine, Sep. 2018, pp. 71-82 (12 pages).

* cited by examiner

*Primary Examiner* — Kenneth L Thompson

(74) *Attorney, Agent, or Firm* — Osha Bergman Watanabe & Burton LLP

(57) ABSTRACT

A method includes locating a first set of electromagnetic field emitting devices in a vicinity of the pressure source, using the first set of electromagnetic field emitting devices to generate a first electromagnetic field in a first shape that forms an enclosure containing the pressure source, pumping a magnetic fluid into the enclosure at a pumping pressure, and increasing the pumping pressure to overcome the pressure from the pressure source.

20 Claims, 9 Drawing Sheets

DYNAMIC FERROFLUID SHIELD FOR WELL CONTROL

BACKGROUND

In the oil and gas industry, hydrocarbons are located in formations far beneath the Earth's surface. Wells are drilled into these formations to produce these hydrocarbons. Wells consist of at least one hole drilled into the Earth's surface supported by at least one casing string. When a well is being drilled, completed, and worked over, well control is a primary concern. Well control includes systems and methods that prevent and mitigate an uncontrolled release of wellbore fluids to the Earth' surface. Primary well control defenses include pump pressure, kill mud, one-way valves, etc. However, when the influx of wellbore fluids manages to reach the Earth's surface, there are few systems available to contain the wellbore fluids.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods and systems for containing pressure coming from a pressure source. The method includes locating a first set of electromagnetic field emitting devices in a vicinity of the pressure source, using the first set of electromagnetic field emitting devices to generate a first electromagnetic field in a first shape that forms an enclosure containing the pressure source, pumping a magnetic fluid into the enclosure at a pumping pressure, and increasing the pumping pressure to overcome the pressure from the pressure source.

The system includes a first set of electromagnetic field emitting devices, a first electromagnetic field, created by the first set of electromagnetic field emitting devices, having a first shape that forms an enclosure, a vessel containing a magnetic fluid, and a pump configured to pump the magnetic fluid, at a pumping pressure, from the vessel into the enclosure. The pumping pressure is adjustable to overcome the pressure coming from the pressure source.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
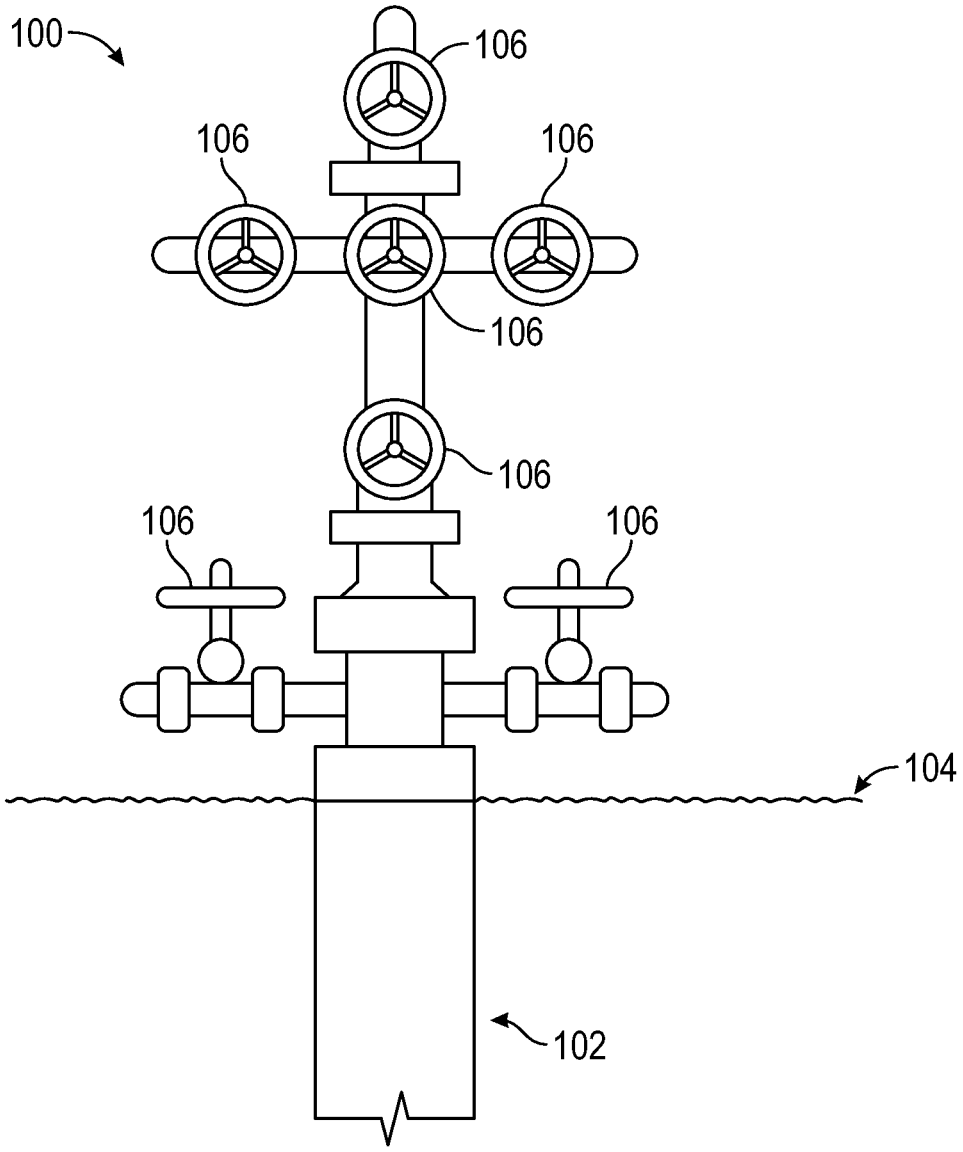
FIG. 1 shows a wellhead in accordance with one or more embodiments.

FIG. 1 shows an example of a wellhead (100). The particular structure shown is for illustration purposes only; the scope of this disclosure is intended to encompass any type of wellhead. In general, a wellhead is a structure that caps a well (102) at the surface (104). The well (102) may be a hydrocarbon well that has been drilled/completed or is in the process of being drilled/completed. In some cases, a drilling rig or a workover rig with a blow-out preventer may be connected to the wellhead (100). The well (102) may have any wellbore geometry and structure without departing from the scope of the disclosure herein. The surface (104) may be any location along the surface of the Earth. Further, the wellhead (100) may be located in a subsea application and the surface (104) may be the ocean floor.

The wellhead (100) further provides the structural and pressure containing interface for the drilling, completion, and production equipment. The wellhead (100) may also house the casing hangers and tubing hangers for the well (102). The wellhead (100) typically has a plurality of valves (106). Each valve (106) may be any type of valve known in the art, such as a gate valve or a hydraulic valve. The valves (106) may be used to access the downhole portion of the well (102) and any internal components of the wellhead (100), such as the casing/tubing hanger.

When the valves (106) are closed, there should be no fluid flowing from the well (102) to the surface. In the presence of a kick, the valves (106) may be used to shut in the well (102), i.e., stop fluid from flowing from the well (102) to the external environment of the wellhead (100). Further, if a blowout preventor is connected to the wellhead (100), the blowout preventer may be used to shut in the well (102). When the well is shut in, a kill mud, i.e., a mud that will create a bottom hole pressure greater than the pressure of the influx of fluids, may be pumped into the well (102) to kill the well (102) and stop the kick.

However, when the kick is improperly mitigated and the pressure of the kick overcomes the pressure rating of the wellhead (100) and the valves (106), a blowout may occur. A blowout may also occur due to the failure of the blowout preventer. A blowout is a scenario when wellbore fluids, such as hydrocarbons or drilling fluids, are uncontrollably released from the well (102). A historic example of a blowout is the British Petroleum (BP) Macondo blowout. In the case of the BP Macondo blowout, multiple failed well control methods were attempted.

The only successful well control attempt included drilling a new well that intercepted the Macondo well and pumping cement into the Macondo well to kill the well. This form of well control is a high risk and time-consuming operation, thus, methods and systems that may be used to contain a blowout from a well (102), while minimizing risk and saving time, are beneficial. As such, embodiments disclosed herein present systems and methods which create a pressure barrier external to the wellhead (100) using electromagnetic field emitting devices (EMEDs) and a magnetic fluid.

Figure 2:
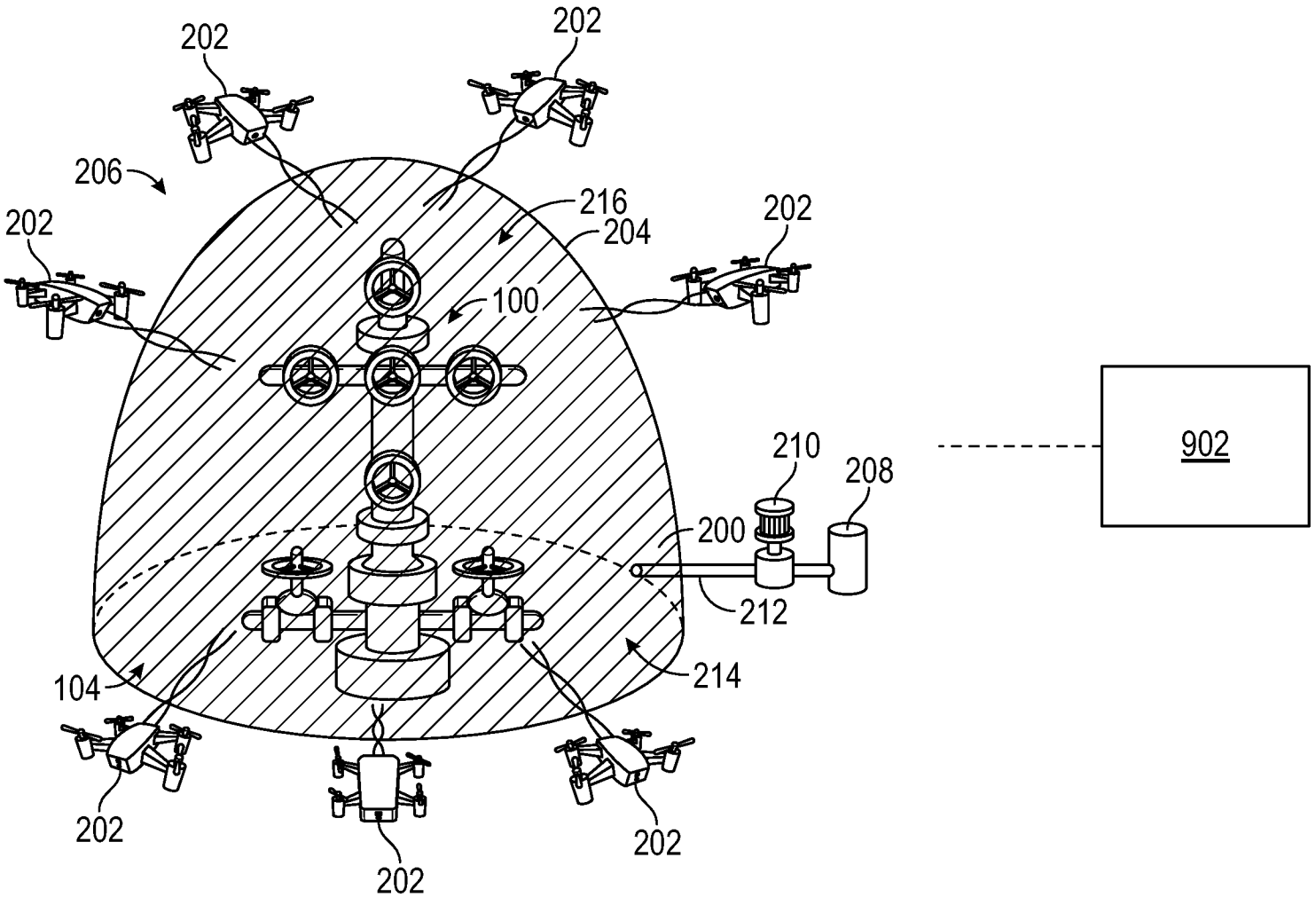
FIG. 2 shows a system in accordance with one or more embodiments.

FIG. 2 shows a system in accordance with one or more embodiments. Specifically, FIG. 2 shows a pressure barrier, created by a magnetic fluid (200) and a first set of EMEDs (202), around a wellhead (100). Components of FIG. 2 that are the same as or similar to components described in FIG. 1 have not been redescribed for purposes of readability and have the same description and function as described above. In one or more embodiments, the wellhead (100) in FIG. 2 is a pressure source that is emitting a pressure. That is, the well (102) that the wellhead (100) is capping may be experiencing or about to experience a blowout.

FIG. 2 shows a first set of EMEDs (202) that have been maneuvered to surround the wellhead (100). The first set of EMEDs (202) cooperate to produce a first electromagnetic field (204). The first set of EMEDs (202) control a first shape and a strength of the first electromagnetic field (204). The first shape of the first electromagnetic field (204) may be a dome-like shape or any other shape sufficient to enclose the wellhead. The first shape of first electromagnetic field (204) forms an enclosure (206) around the wellhead (100). In some embodiments, a portion of the enclosure (206) may be delineated by the surface (104) and a portion of the enclosure (206) may be delineated by the first shape of the first electromagnetic field (204).

A vessel (208) containing a magnetic fluid (200) is located on or near the surface (104). A pump (210) pumps the magnetic fluid (200), at a pumping pressure, from the vessel (208) into the enclosure (206) formed by the first electromagnetic field (204). The pump (210) may be any type of pump known in the art, such as an electric pump. The pump (210) may be controlled manually, by a remote actuation device (not shown), or by a computer (902) system that may, in some embodiments, also control the EMEDs (202). The vessel (208) may be any piece of equipment able to store a fluid, such as a tank. A conduit (212), such as a pipeline, passes through the first electromagnetic field (204) and directs the magnetic fluid (200) from the vessel (208) to the enclosure (206). The pump (210) is hydraulically connected to the vessel (208) and the conduit (212). Further, there may be more than one pumps (210), vessels (208), and/or conduits (212) without departing from the scope of the disclosure herein.

The magnetic fluid (200) may fill the enclosure (206) from a first portion (214), proximal the pressure source, to a second portion (216), distal the pressure source. The pumping pressure is adjustable to overcome the pressure coming from the pressure source. Thus, a blowout coming from the wellhead (100) may be contained by the pumping pressure of the magnetic fluid (200) in the enclosure (206). The pressure and temperature of the magnetic fluid (200) may be modified to adjust for density and viscosity. Further, in the presence of a fire caused by a blowout from the wellhead (100), the enclosure (206) may be air-tight preventing extra oxygen from feeding the fire thus extinguishing the fire.

Figure 3:
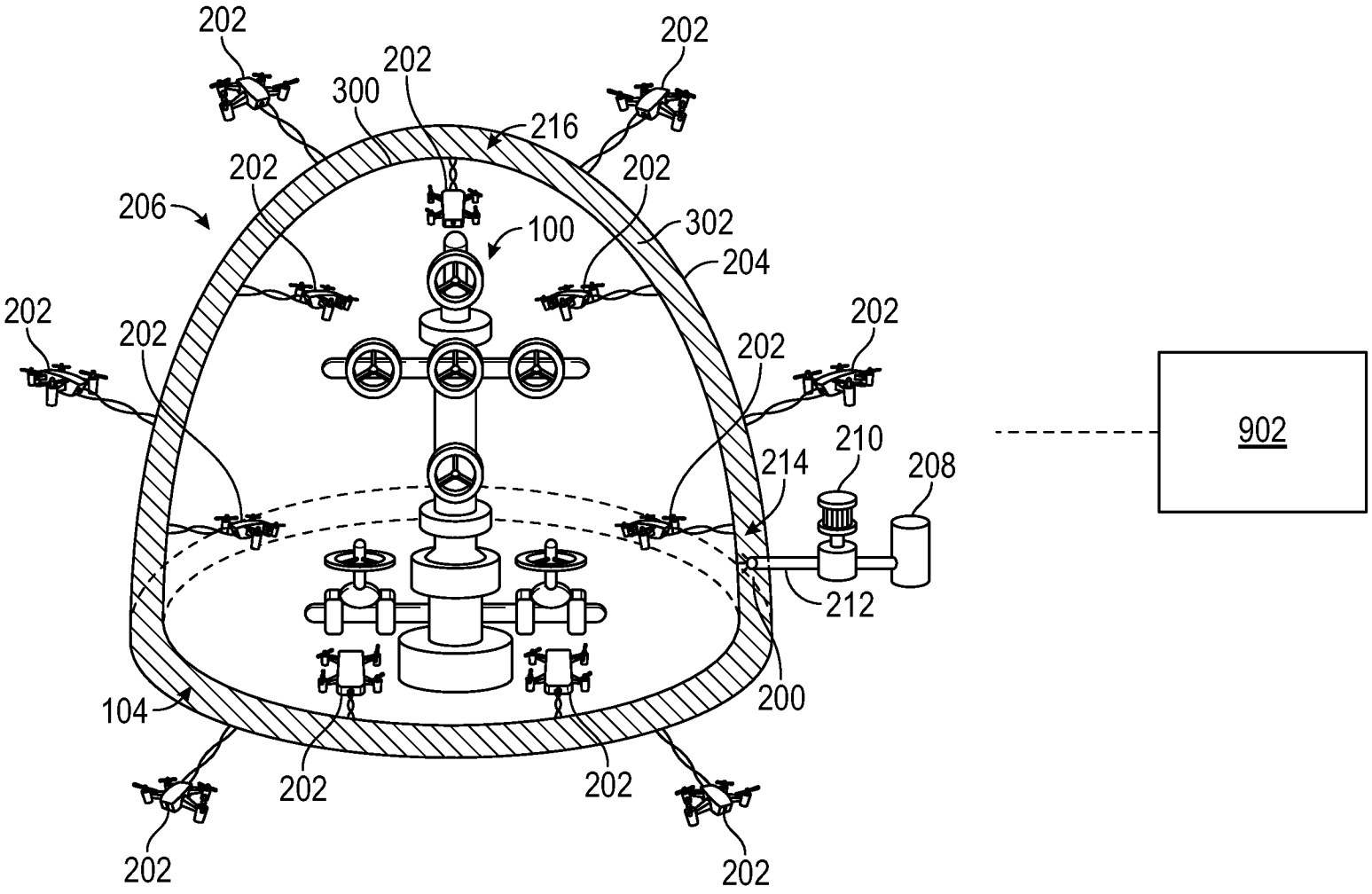
FIG. 3 shows a system in accordance with one or more embodiments.

In one or more embodiments, the magnetic fluid (200) may be a ferrofluid. A ferrofluid is a liquid that can become highly magnetized in the presence of a magnetic field. A ferrofluid is a colloidal fluid that is made of nanoscale ferromagnetic particles suspended in a carrier fluid, such as water or an organic solvent like kerosene. Further, the ferromagnetic particles are coated in a surfactant to prevent the ferromagnetic particle from clumping together within the carrier fluid. In one or more embodiments, the composition of the ferrofluid may be 5% ferromagnetic particles, 10% surfactant, and 85% carrier fluid. The ferromagnetic particles may have a diameter of less than 10 nanometers. The ferromagnetic particles may be magnetite or hematite FIG. 3 shows a system in accordance with one or more embodiments. Specifically, FIG. 3 shows a pressure barrier, formed by a magnetic fluid, a first set of EMEDs (202), and a second set of EMEDs (202), around a wellhead (100). Components of FIG. 3 that are the same as or similar to components described in FIGS. 1 and 2 have not been redescribed for purposes of readability and have the same description and function as described above.

A first set of EMEDs (202) have been maneuvered around the wellhead (100) and have created a first electromagnetic field (204) as shown in FIG. 2. A second set of EMEDs (202) are disposed within the enclosure (206) formed by the first electromagnetic field (204). A second electromagnetic field (300) is created by the second set of EMEDs (202). The second electromagnetic field (300) is located between the wellhead (100) and the first electromagnetic field (204). The second electromagnetic field (300) has a second shape that forms an interstitial space (302) between the first electromagnetic field and the second electromagnetic field (300). In one or more embodiments, the first shape and the second shape are dome-like shapes.

A pump (210) pumps the magnetic fluid (200) from a vessel (208) into the interstitial space (302) using the conduit (212). The magnetic fluid (200) may fill the interstitial space (302) from the first portion (214) of the enclosure (206) to the second portion (216) of the enclosure (206). The two magnetic fields (204, 300) push the magnetic fluid (200) in opposing directions effectively sandwiching the magnetic fluid (200) within the interstitial space (302) to form a shield or pressure barrier around the wellhead (100) or pressure source. The magnetic fluid (200) may be pumped into the interstitial space (302) at a pumping pressure that overcomes a pressure coming from the pressure source/wellhead (100).

In some embodiments, the EMEDs (202) may be anchored to the surface (104) rather than maneuverable around the wellhead (100). The EMEDs (202) may be anchored to the surface (104), around the wellhead (100), using any anchors known in the art such as a mechanical rock anchor or an ocean anchor for subsea applications. The EMEDs (202) also may be anchored or suspended above the surface (104) by any known means including, for example and without limitation, wires or scaffolding. The EMEDs (202) in FIGS. 2 and 3 are shown in a specific arrangement around the wellhead (100), however the number of EMEDs (202) and the arrangement of the EMEDs (202) around the wellhead (100) may be any number/arrangement without departing from the scope of the disclosure herein.

Figure 4:
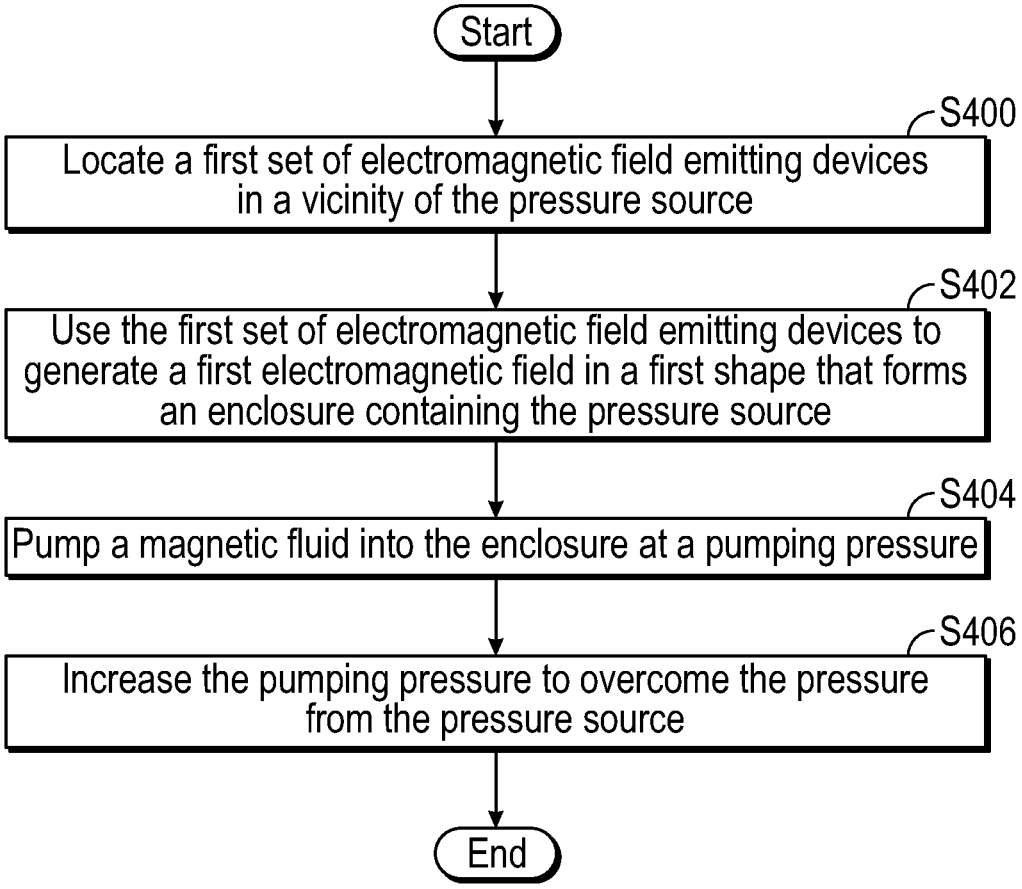
FIG. 4 shows a flowchart in accordance with one or more embodiments.

FIG. 4 shows a flowchart in accordance with one or more embodiments. The flowchart outlines a method for containing pressure coming from a pressure source. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a first set of EMEDs (202) are located in a vicinity of the pressure source (S400). The first set of EMEDs (202) may be manually placed around the pressure source, or the first set of EMEDs (202) may be maneuvered around the pressure source under their own power or by another vehicle. In one or more embodiments, the pressure source may be a wellhead (100), and the wellhead (100) may be experiencing a blowout.

The first set of EMEDs (202) are used to generate a first electromagnetic field (204) in a first shape that forms an enclosure (206) containing the pressure source (S402). The location of the EMEDs (202) and the EMEDs themselves control the size and shape of the first electromagnetic field (204). In one or more embodiments, the first shape is a dome-like shape, and the enclosure is delineated by a surface (104) and the first shape of the first electromagnetic field (204).

A magnetic fluid (200) is pumped into the enclosure (206) at a pumping pressure (S404). the magnetic fluid (200) may fill the enclosure (206) from a first portion (214) proximal the pressure source to a second portion (216) distal the pressure source. The magnetic fluid (200) may be pumped into the enclosure (206) using a pump (210) and a conduit (212). The pump (210) may draw the magnetic fluid (200) from a storage vessel (208), and the pump (210) may pump the magnetic fluid (200) through the conduit (212) into the enclosure. In one or more embodiments, the magnetic fluid (200) may be a ferrofluid. The pumping pressure is increased to overcome the pressure from the pressure source (S406). Thus, a fluid, such as hydrocarbons, that may be flowing from the wellhead (100) may be stopped by the pumping pressure.

Figure 5:
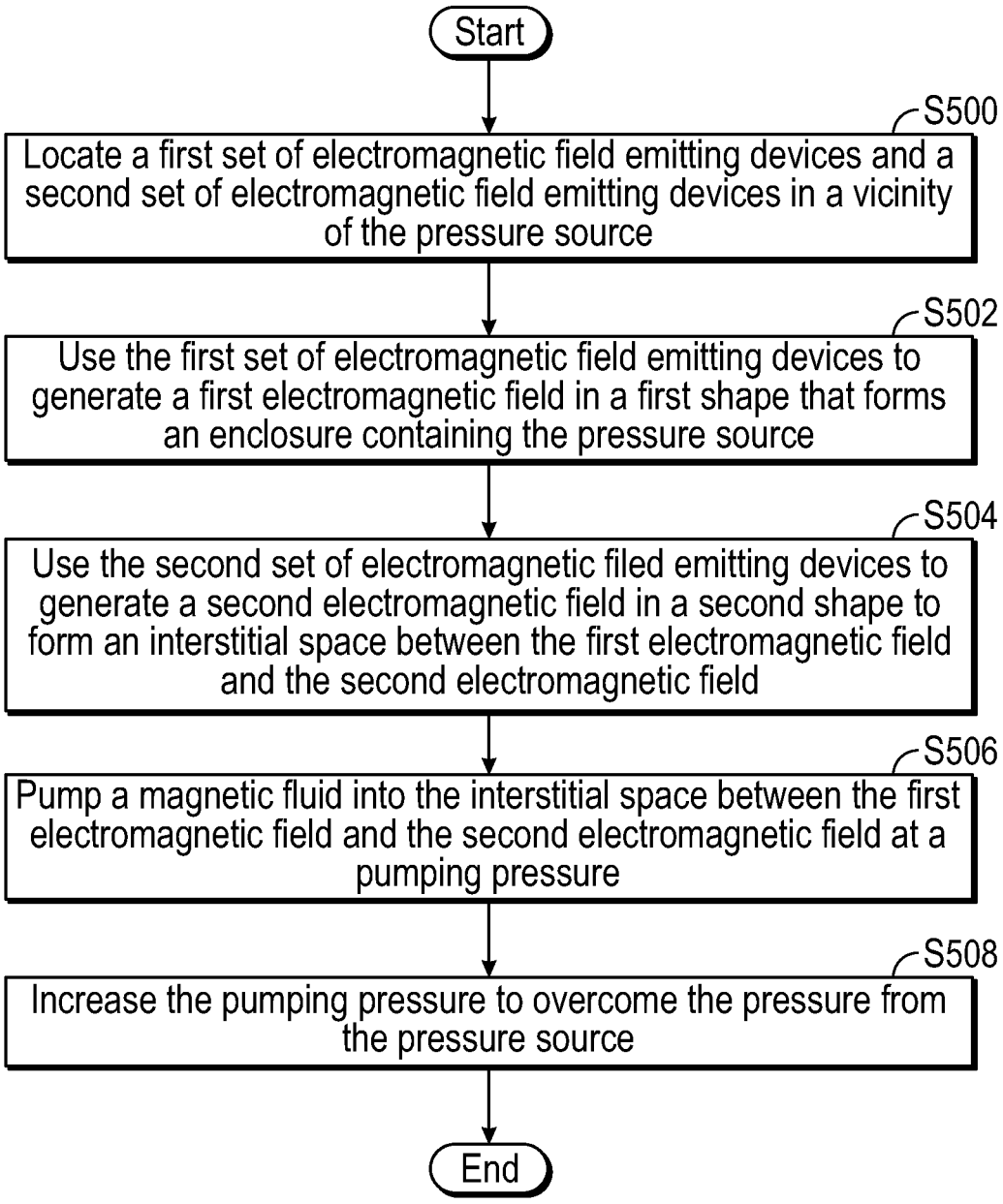
FIG. 5 shows a flowchart in accordance with one or more embodiments.

FIG. 5 shows a flowchart in accordance with one or more embodiments. The flowchart outlines another method for containing pressure coming from a pressure source. While the various blocks in FIG. 5 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a first set of EMEDs (202) and a second set of EMEDs (202) are located in a vicinity of the pressure source (S500). The second set of EMEDs (202) may be located closer to the pressure source than the first set of EMEDs (202). That is, the second set of EMEDs (202) may be located between the first set of EMEDs (202) and the pressure source. The first set of EMEDs (202) generate a first electromagnetic field (204) in a first shape that forms an enclosure (206) containing the pressure source (S502). The second set of EMEDs (202) generate a second electromagnetic field (300) in a second shape to form an interstitial space (302) between the first electromagnetic field (204) and the second electromagnetic field (300) (S504).

The magnetic fluid (200) is pumped at a pumping pressure into the interstitial space (302) between the first electromagnetic field (204) and the second electromagnetic field (300) (S506). In one or more embodiments, both the first shape and the second shape are a dome-like shape and the magnetic fluid (200) is a ferrofluid. The pumping pressure is increased to overcome the pressure from the pressure source (S508). Thus, a fluid, such as hydrocarbons, that may be flowing from the wellhead (100) may be stopped by the pumping pressure. Once the pressure is contained at the pressure source using either the method depicted in FIG. 4 or the method depicted in FIG. 5, the well (102) may be killed or shut in using standard well control equipment. For example, a kill fluid may be pumped into the well (102).

Figure 6B:
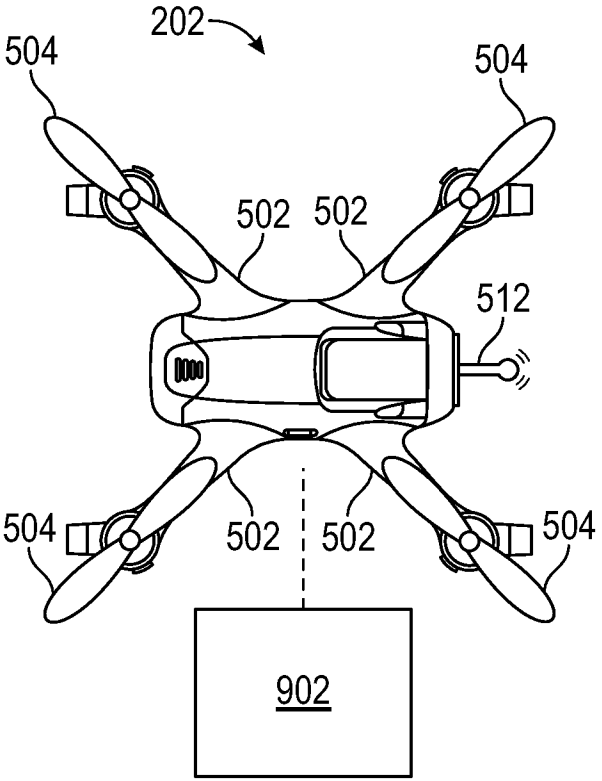
FIGS. 6A and 6B show an apparatus in accordance with one or more embodiments.
Figure 6A:
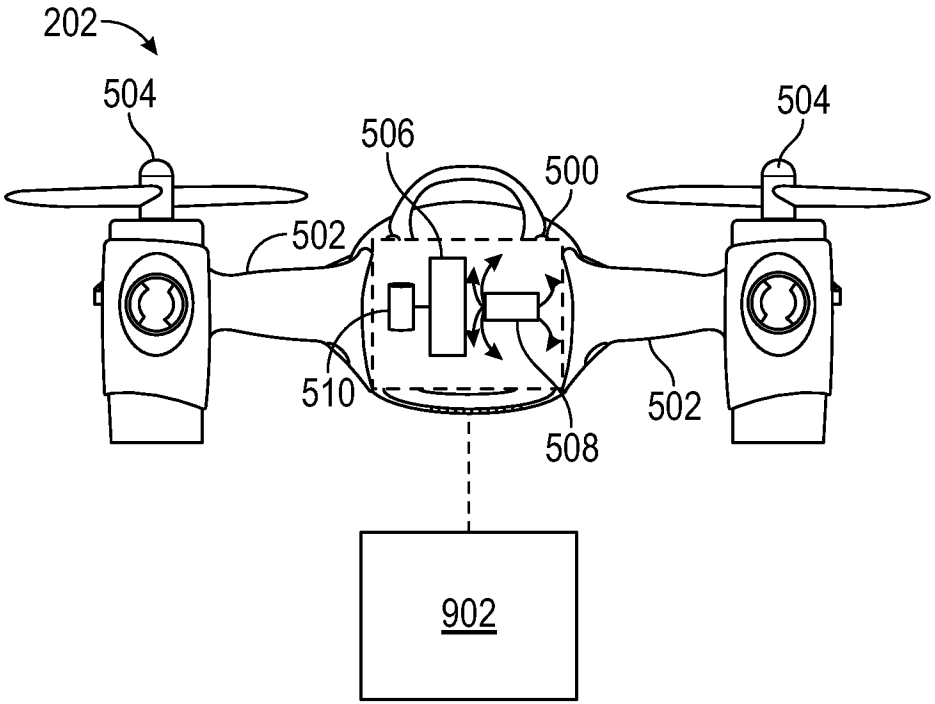

FIGS. 6*a* and 6*b* show an apparatus in accordance with one or more embodiments. Specifically, FIG. 6*a* shows a side view of an EMED (202), and FIG. 6*b* shows a top view of the EMED (202) in accordance with one or more embodiments. The EMED (202) shown in FIGS. 6*a* and 6*b* is maneuverable in air using a computer (902) system. The EMED (202) may a body (500) with at least one arm (502). In further embodiments, the EMED (202) has four arms (502). Each arm (502) has at least one propeller (504) connected to it. The propellers (504) have the ability to rotate at different speeds, all controlled by the computer (902) system. The EMED (202) is shown having four arms (502) and four propellers (504). The propellers (504) aid in lifting the EMED (202) into the air and maneuvering the EMED (202) in the air. The EMED (202) may also have a camera (not pictured) that transmits live footage to the computer (902) system Within the body (500) of the EMED (202), there is a superconductor (506) magnetized by a magnet (508). A supercapacitor (510) may be controlled by the computer (902) system to power the magnetized superconductor (506) and produce an electromagnetic field, such as the first electromagnetic field (204) and the second electromagnetic field (300) described in this disclosure. The body (500) of the EMED (202) may have an antenna (512). The antenna (512) transmits the electromagnetic field away from the EMED (202). The position of the antenna (512) may be adjusted using the computer (902) system. Thus, the direction (and strength) of the electromagnetic field may be changed by the computer (902) system controlling the position of the antenna (512), the position of the EMED (202), and the power being emitted by the supercapacitor (510).

Figure 7B:
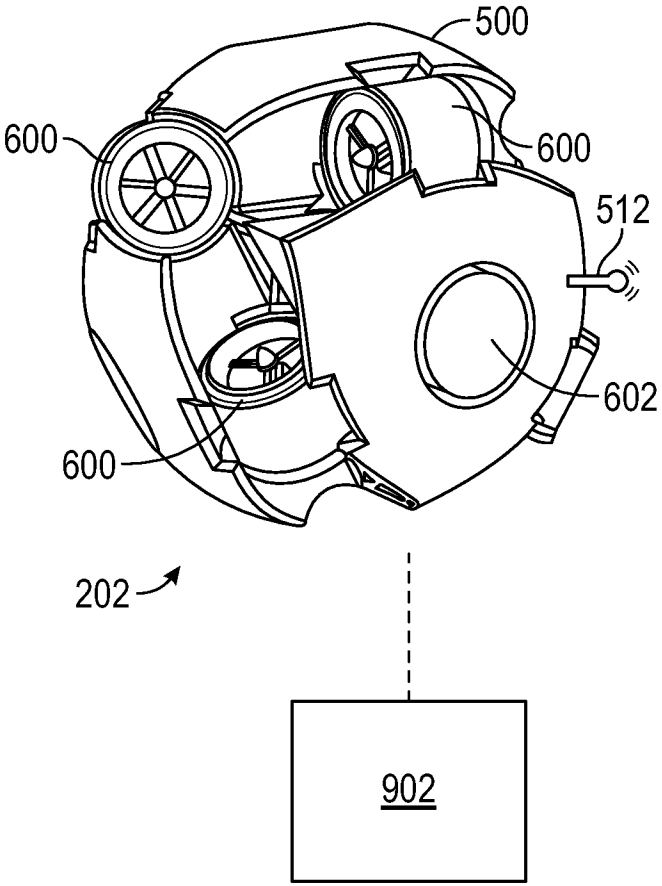
FIGS. 7A and 7B show an apparatus in accordance with one or more embodiments.
Figure 7A:
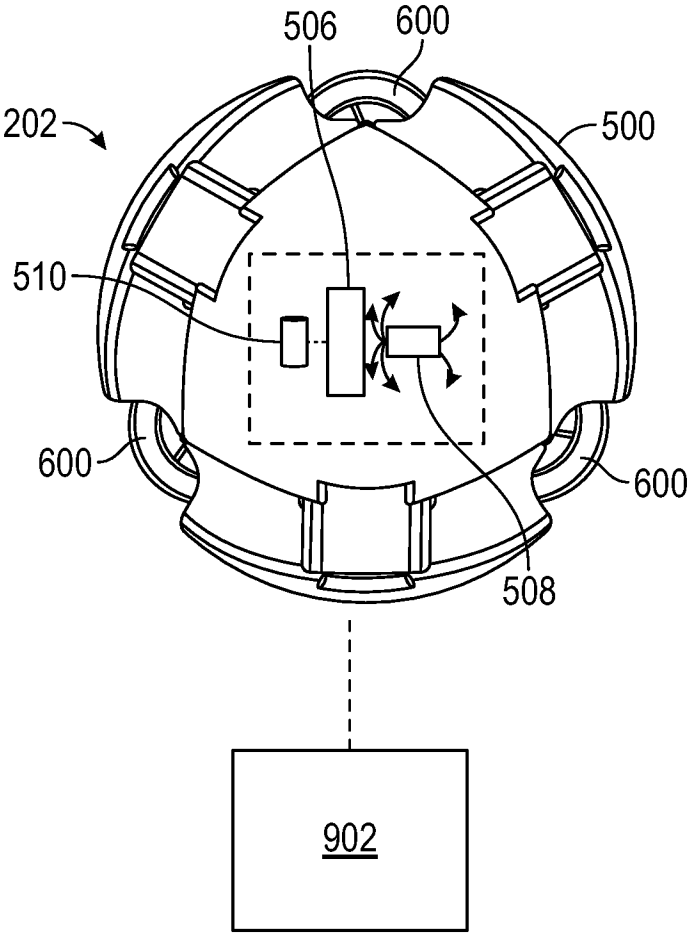

FIGS. 7*a* and 7*b* show an apparatus in accordance with one or more embodiments. Components of FIGS. 7*a* and 7*b* that are the same as or similar to components described in FIGS. 6*a* and 6*b* have not been redescribed for purposes of readability and have the same description and function as described above. Specifically, FIG. 7*a* shows a top view of an EMED (202), and FIG. 7*b* shows a side view of an EMED (202) in accordance with one or more embodiments. The EMED (202) may be made of a body (500) having at least one thruster (600). In accordance with one or more embodiments, the EMED (202) may have six thrusters (600) to accurately maneuver the EMED. The thrusters (600) enable the EMED (202) to be maneuvered in an underwater/subsea environment by leveraging water resistance.

Similar to the EMED (202) shown in FIGS. 6*a* and 6*b*, the body of the EMED (202) may house a superconductor (506), a supercapacitor (510), and a magnet (508), all used to create a magnetic field. A camera (602) may be attached to the body (500) of the EMED (202). The camera (602) may deliver live footage to the computer (902) system. An antenna (512) is also attached to the body (500) of the EMED (202) and may emit the magnetic field from the EMED (202). The computer (902) system may also be used to control the location of the EMED (202), the position of the antenna (512), and the energy emitted by the supercapacitor (510). The computer system (902) may also be used to control the pump (210) and therefore the flow of magnetic fluid (200) into the enclosure (206). The computer (902) system may be located near to or distant from the EMEDs (202) and the pump (210) provided there is communication therebetween. Communication may be by any known means, including wired connection, wireless connection, the internet, or any combination thereof.

Figure 8:
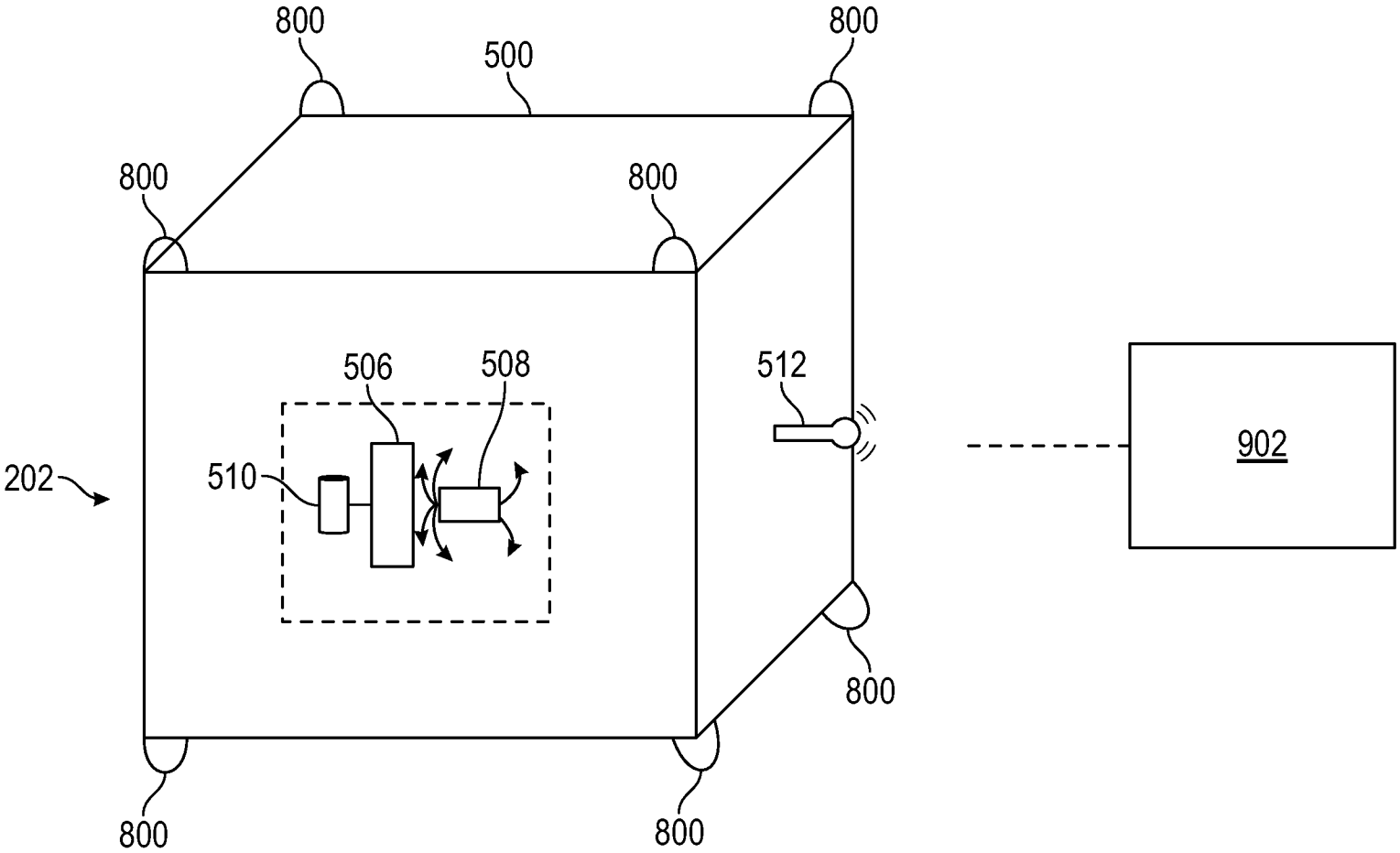
FIG. 8 shows an apparatus in accordance with one or more embodiment.

FIG. 8 shows an apparatus in accordance with one or more embodiments. Components of FIG. 8 that are the same as or similar to components described in FIGS. 6*a*-7*b* have not been redescribed for purposes of readability and have the same description and function as described above. Specifically, FIG. 8 shows an EMED (202) in accordance with one or more embodiments. The EMED (202) may be made of a body (500) having at least one anchor (800). In accordance with one or more embodiments, the EMED (202) may have eight anchors (800). The anchors (800) may be used to anchor the EMED (202) to a surface (104). The anchors (800) may also be used to hang the EMED (202) from a structure, such as a derrick of a drilling rig or other scaffolding. The anchors (800) may be made of a material having a high shear strength, such as steel. The anchors (800) may be formed in a half circle shape, as shown in FIG. 8, or the anchors ( ) may be formed in any shape that allows the anchors (800) to connect the EMED (800) to a surface (104) or a structure.

Similar to the EMEDs (202) shown in FIGS. 6*a*-7*b*, the body (500) of the EMED (202) may house a superconductor (506), a supercapacitor (510), and a magnet (508), all used to create a magnetic field. An antenna (512) is also attached to the body (500) of the EMED (202) and may emit the magnetic field from the EMED (202). The computer (902) system may also be used to control the position of the antenna (512) and the energy emitted by the supercapacitor (510). The computer system (902) may also be used to control the pump (210) and therefore the flow of magnetic fluid (200) into the enclosure (206).

Figure 9:
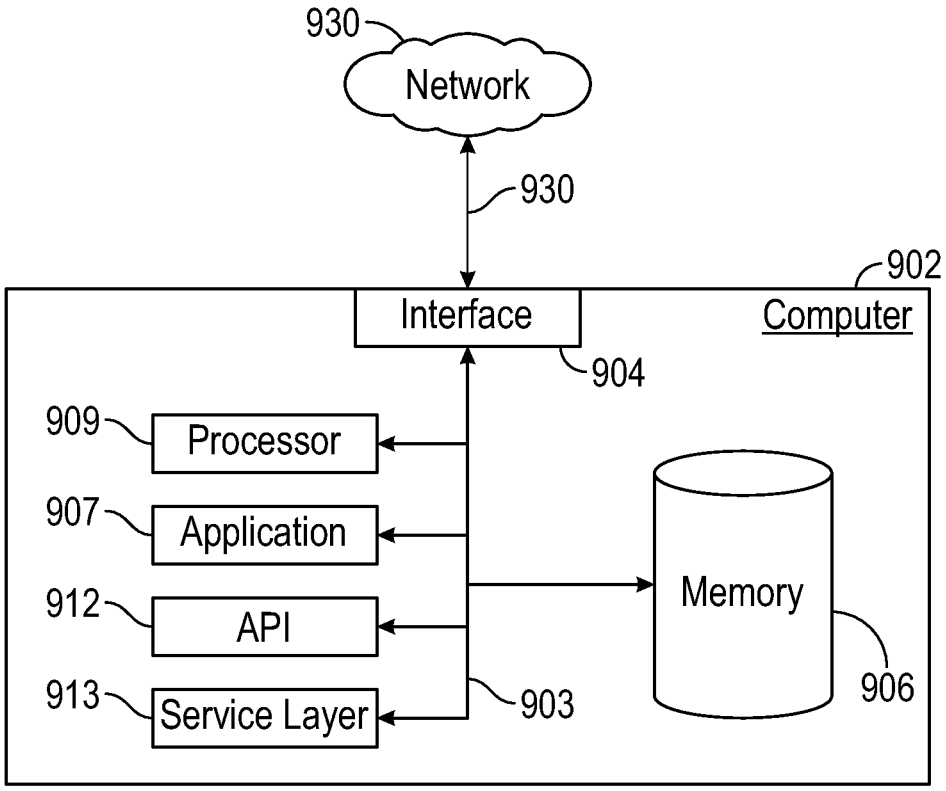
FIG. 9 shows a computer system in accordance with one or more embodiments.

FIG. 9 shows a computer (902) system in accordance with one or more embodiments. Specifically, FIG. 9 shows a block diagram of a computer (902) system used to provide computational functionalities associated with described algorithms, methods, functions, processes, flows, and procedures as described in the instant disclosure, according to an implementation. The illustrated computer (902) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device.

Additionally, the computer (902) may include a computer that includes an input device, such as a keypad, keyboard, touch screen, or other device that can accept user information, and an output device that conveys information associated with the operation of the computer (902), including digital data, visual, or audio information (or a combination of information), or a GUI.

The computer (902) can serve in a role as a client, network component, a server, a database or other persistency, or any other component (or a combination of roles) of a computer system for performing the subject matter described in the instant disclosure. The illustrated computer (902) is communicably coupled with a network (930). In some implementations, one or more components of the computer (902) may be configured to operate within environments, including cloud-computing-based, local, global, or other environment (or a combination of environments).

At a high level, the computer (902) is an electronic computing device operable to receive, transmit, process, store, or manage data and information associated with the described subject matter. According to some implementations, the computer (902) may also include or be communicably coupled with an application server, e-mail server, web server, caching server, streaming data server, business intelligence (BI) server, or other server (or a combination of servers).

The computer (902) can receive requests over network (930) from a client application (for example, executing on another computer (902)) and responding to the received requests by processing the said requests in an appropriate software application. In addition, requests may also be sent to the computer (902) from internal users (for example, from a command console or by other appropriate access method), external or third-parties, other automated applications, as well as any other appropriate entities, individuals, systems, or computers.

Each of the components of the computer (902) can communicate using a system bus (903). In some implementations, any or all of the components of the computer (902), both hardware or software (or a combination of hardware and software), may interface with each other or the interface (904) (or a combination of both) over the system bus (903) using an application programming interface (API) (912) or a service layer (913) (or a combination of the API (912) and service layer (913). The API (912) may include specifications for routines, data structures, and object classes. The API (912) may be either computer-language independent or dependent and refer to a complete interface, a single function, or even a set of APIs. The service layer (913) provides software services to the computer (902) or other components (whether or not illustrated) that are communicably coupled to the computer (902).

The functionality of the computer (902) may be accessible for all service consumers using this service layer. Software services, such as those provided by the service layer (913), provide reusable, defined business functionalities through a defined interface. For example, the interface may be software written in JAVA, C++, or other suitable language providing data in extensible markup language (XML) format or other suitable format. While illustrated as an integrated component of the computer (902), alternative implementations may illustrate the API (912) or the service layer (913) as stand-alone components in relation to other components of the computer (902) or other components (whether or not illustrated) that are communicably coupled to the computer (902). Moreover, any or all parts of the API (912) or the service layer (913) may be implemented as child or sub-modules of another software module, enterprise application, or hardware module without departing from the scope of this disclosure.

The computer (902) includes an interface (904). Although illustrated as a single interface (904) in FIG. 9, two or more interfaces (904) may be used according to particular needs, desires, or particular implementations of the computer (902). The interface (904) is used by the computer (902) for communicating with other systems in a distributed environment that are connected to the network (930). Generally, the interface (904) includes logic encoded in software or hardware (or a combination of software and hardware) and operable to communicate with the network (930). More specifically, the interface (904) may include software supporting one or more communication protocols associated with communications such that the network (930) or interface's hardware is operable to communicate physical signals within and outside of the illustrated computer (902).

The computer (902) includes at least one computer processor (905). Although illustrated as a single computer processor (905) in FIG. 9, two or more processors may be used according to particular needs, desires, or particular implementations of the computer (902). Generally, the computer processor (905) executes instructions and manipulates data to perform the operations of the computer (902) and any algorithms, methods, functions, processes, flows, and procedures as described in the instant disclosure.

The computer (902) also includes a non-transitory computer (902) readable medium, or a memory (906), that holds data for the computer (902) or other components (or a combination of both) that can be connected to the network (930). For example, memory (906) can be a database storing data consistent with this disclosure. Although illustrated as a single memory (906) in FIG. 9, two or more memories may be used according to particular needs, desires, or particular implementations of the computer (902) and the described functionality. While memory (906) is illustrated as an integral component of the computer (902), in alternative implementations, memory (906) can be external to the computer (902).

The application (907) is an algorithmic software engine providing functionality according to particular needs, desires, or particular implementations of the computer (902), particularly with respect to functionality described in this disclosure. For example, application (907) can serve as one or more components, modules, applications, etc. Further, although illustrated as a single application (907), the application (907) may be implemented as multiple applications (907) on the computer (902). In addition, although illustrated as integral to the computer (902), in alternative implementations, the application (907) can be external to the computer (902).

There may be any number of computers (902) associated with, or external to, a computer system containing computer (902), each computer (902) communicating over network (930). Further, the term "client," "user," and other appropriate terminology may be used interchangeably as appropriate without departing from the scope of this disclosure. Moreover, this disclosure contemplates that many users may use one computer (902), or that one user may use multiple computers (902).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. A method for containing pressure coming from a pressure source, the method comprising:

locating a first set of electromagnetic field emitting devices in a vicinity of the pressure source;

using the first set of electromagnetic field emitting devices to generate a first electromagnetic field in a first shape that forms an enclosure containing the pressure source;

pumping a magnetic fluid into the enclosure at a pumping pressure; and increasing the pumping pressure to overcome the pressure from the pressure source.

2. The method of claim 1, wherein the pressure source comprises a wellhead.

3. The method of claim 2, wherein increasing the pumping pressure to overcome the pressure from the pressure source comprises stopping fluid from flowing from the wellhead.

4. The method of claim 1, wherein the magnetic fluid comprises a ferrofluid.

5. The method of claim 1, wherein pumping the magnetic fluid into the enclosure comprises filling the enclosure from a first portion proximal the pressure source to a second portion distal the pressure source.

6. The method of claim 1, further comprising locating a second set of electromagnetic field emitting devices in the vicinity of the pressure source, wherein the second set of electromagnetic field emitting devices are located closer to the pressure source than the first set of electromagnetic field emitting devices.

7. The method of claim 6, further comprising using the second set of electromagnetic field emitting devices to generate a second electromagnetic field in a second shape to form an interstitial space between the first electromagnetic field and the second electromagnetic field.

8. The method of claim 7, wherein pumping the magnetic fluid into the enclosure at the pumping pressure comprises pumping the magnetic fluid into the interstitial space between the first electromagnetic field and the second electromagnetic field.

9. The method of claim 7, wherein the first shape and the second shape are a dome-like shape.

10. The method of claim 1, further comprising securing the pressure source using standard well control equipment.

11. A system for containing pressure coming from a pressure source, the system comprising:

a first set of electromagnetic field emitting devices;

a first electromagnetic field, created by the first set of electromagnetic field emitting devices, having a first shape that forms an enclosure;

a vessel containing a magnetic fluid; and a pump configured to pump the magnetic fluid, at a pumping pressure, from the vessel into the enclosure, wherein the pumping pressure is adjustable to overcome the pressure coming from the pressure source.

12. The system of claim 11, wherein the first set of electromagnetic field emitting devices each comprise a magnetized superconductor and an antenna.

13. The system of claim 12, wherein the first shape is controlled by a position of each antenna on each electromagnetic field emitting device.

14. The system of claim 11, wherein the first set of electromagnetic field emitting devices are powered by a supercapacitor.

15. The system of claim 11, wherein the first set of electromagnetic field emitting devices are maneuverable.

16. The system of claim 11, wherein the pump directs the magnetic fluid into the enclosure using a conduit that passes through the first electromagnetic field.

17. The system of claim 11, further comprising a second set of electromagnetic field emitting devices.

18. The system of claim 17, wherein the second set of electromagnetic field emitting devices are disposed within the enclosure.

19. The system of claim 18, further comprising a second electromagnetic field, created by the second set of electromagnetic field emitting devices, having a second shape that forms an interstitial space between the first electromagnetic field and the second electromagnetic field.

20. The system of claim 19, wherein the first shape and the second shape are a dome-like shape.

* * * * *